US007358453B2

(12) United States Patent
Tsunoda

(10) Patent No.: US 7,358,453 B2
(45) Date of Patent: Apr. 15, 2008

(54) SWINGING SWITCH DEVICE

(75) Inventor: Koji Tsunoda, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 11/122,250

(22) Filed: May 5, 2005

(65) Prior Publication Data

US 2005/0247551 A1 Nov. 10, 2005

(30) Foreign Application Priority Data

May 7, 2004 (JP) ..... P2004-138515

(51) Int. Cl.
*H01H 13/00* (2006.01)
*H01H 3/00* (2006.01)

(52) U.S. Cl. ..... 200/339; 200/302.1

(58) Field of Classification Search ..... 200/339
See application file for complete search history.

(56) References Cited

U.S. PATENT DOCUMENTS 3,742,171 A 6/1973 Howe ..... 200/168 G
4,965,417 A * 10/1990 Massie ..... 200/86.5
5,105,059 A 4/1992 Sorenson et al. ..... 200/302.3
5,117,074 A * 5/1992 Yanai et al. ..... 200/302.3
5,421,659 A * 6/1995 Liang ..... 400/472
5,952,630 A * 9/1999 Filion et al. ..... 200/5 R
6,380,500 B1 * 4/2002 Lin ..... 200/302.3
6,800,825 B1 * 10/2004 Sasaki et al. ..... 200/402

FOREIGN PATENT DOCUMENTS

CN 2783517 * 5/2006
EP 1 002 678 A2 11/1999
EP 1 111 637 A2 12/2000
JP 2001-297648 A 10/2001
JP 2001297648 A * 10/2001

* cited by examiner

*Primary Examiner*—Elvin Enad
*Assistant Examiner*—Lheiren Mae A. Anglo
(74) *Attorney, Agent, or Firm*—Morgan, Lewis & Bockius LLP.

(57) ABSTRACT

On a switch cover attached to a switch body incorporating a switching mechanism and a regulating mechanism from above, an opening is provided to expose a part of an operation knob and to allow the operation knob to be swung. A through hole is provided on the switch body so as to vertically penetrate through the same in a position of the switch body in communication with the opening. Thus, fine sand that has entered through the opening can be discharged to the outside.

8 Claims, 4 Drawing Sheets

SWINGING SWITCH DEVICE

BACKGROUND OF THE INVENTION

The present invention relates to a dust-proof swinging switch device which preferably works as a window regulator switch of an automobile.

A power window system of an automobile according to the related art includes a plurality of window regulator switches provided at the door on the side of the driver's seat. Window regulator switches of this type constitute a so-called swinging switch device having a switching mechanism, the switching mechanism comprising an operation knob which is supported through a regulating mechanism such that it can swing from side to side and which is always returned to and held at a standby position and a circuit board on which a movable piece contacts and leaves a fixed contact according to the swing of the operation knob (see Patent Document 1).

FIG. 3 is a sectional view of an example of a switch device of this type showing a schematic configuration of major parts thereof. A switch body 1 has fixed contacts 2 and 3 which are laterally provided and which constitute a switching mechanism A and a movable piece 4 which is provided above the contacts and which contacts and leaves the fixed contacts 2 and 3. The switch body further has a pivotal support portion which swingably supports the movable piece 4 and which also serves as a common contact 5.

A switch cover 6 is attached to the switch body 1 so as to cover the same from above. The cover 6 is formed with an opening 6*a* in a part of the same located above the switching mechanism A, and an operation knob 7 is mounted such that it is partially exposed at the opening 6*a*. The operation knob 7 is in the form of a rectangular container which is open on the bottom side thereof. The knob has a hollow cylindrical portion 7*a* provided so as to downwardly project from the bottom side to a position inside the switch body 1. The operation knob 7 is pivotally supported on both sides thereof so as to be swingable by a shaft 8 which is provided at the switch body 1.

A pusher 10 is provided in the hollow of the cylindrical portion 7*a*, the pusher is urged outward (downward) by a compression coil spring 9 into elastic contact with a top surface of the movable piece 4. The movable piece 4 is formed with a cam-like surface which is recessed in the middle thereof and curved to have peaks on both sides of the recessed portion. Thus, the switching mechanism A is configured, in which the pusher 10 rotates from side to side (so-called swinging) in elastic contact with the movable piece 4 to urge the movable piece into and out of contact with the fixed contacts 2 and 3 and in which the pusher is normally automatically returned to a standby position at the recessed portion and held in that position. The movable piece 4 having the cam-like surface also serves as a regulating mechanism B in which the pusher 10 is slid by the compression coil spring 9 in elastic contact with the contact piece such that the operation knob 7 is normally held in the standby position in the middle thereof and in which the operation knob can swing from side to side at a predetermined angle.

An arcuate finger engaging portion 7*b* is formed on a side (the left side in FIG. 3) of the operation knob 7 to allow operations of the same. A recess 6*b* that is a continuation of the arcuate feature is formed at the edge of the opening 6*a* of the switch cover 6 associated with the finger engaging section 7*b* to prevent any interference to finger engagement, which provides high operability. The cylindrical portion 7*a* of the operation knob 7 is surrounded by a cylindrical wall 1*a* which projects upward from the switch body 1, and the open end of the wall is located in a high position inside the operation knob 7, which effectively prevents water and foreign substances from entering.

Patent Document 1: JP-A-2001-297648 (see FIGS. 2 and 4)

In the swinging switch device having the above-described configuration, dust and fine sand can enter a gap S between the switch cover 6 and the operation knob 7 at the opening 6*a* of the cover, and they can enter the switch body 1 from the opening at the top of the cylindrical wall 1*a* as indicated by the arrow D in a broken line. Especially, in the case of a window regulator switch of an automobile, dust and fine sand are likely to enter when the window or door is opened and closed and are likely to accumulate in the recess 6*b* formed on the cover 6. Under changes in air pressure and shocks attributable to reactions to the opening and closing of the door, the dust and fine sand can be dropped inward from the recess and then blown up to enter the switch body 1.

When the fine sand which has thus entered reaches the internal switching mechanism A and is deposited on the movable piece 4, the feel of operation of the same in combination with the pusher 10 in sliding contact therewith becomes bad. When the slide of the pusher 10 becomes worse, the swing of the operation knob 7 to the standby position may fail. Obviously, the fine sand can cause conduction failures when it is deposited on the fixed contacts 2 and 3. There is concern about the above-described problem even when only a small amount of fine sand enters because the sand is accumulated without being discharged and is blown up by shocks causes by the opening and closing of the door, which makes the environment undesirable for the switch which must operate with stability for a long period.

SUMMARY OF THE INVENTION

In order to solve the above-described problem, the invention is aimed at providing a swinging switch device from which fine sand that has entered a switch cover through a gap around an operation knob can be discharged, to reduce the amount of sand entering a switch body, and which can therefore be expected to operate stably without any problem in the feel of operation of a regulating mechanism and in the switching function.

(1) A swinging switch apparatus comprising:

a switch body;

a switching mechanism that is accommodated in the switch body;

a switch cover that covers the switch body and is formed with an opening portion;

an operation knob that is provided at the switch body so as to be exposed at the opening portion; and a regulation mechanism that is disposed between the switching mechanism and the operation knob and swingably supports the operation knob, wherein a through hole communicating with the opening portion is formed in the switch body substantially vertically.

(2) A swinging switch apparatus according to (1), wherein the through hole is formed at a position directly under a gap formed between the switch cover and the operation knob in the opening.

(3) A swinging switch apparatus according to (2), wherein the switch cover has a depression so that the operation knob is swung easily, and wherein the through hole is located at a lowest portion of the depression.

(4) A swinging switch apparatus according to (1), wherein an upper portion of the through hole is lager than a lower portion of the through hole.

(5) A swinging switch apparatus according to (1), wherein a plurality of the through holes communicating with the opening portion are formed in the switch body.

(6) A window regulator of an automobile comprising:

a window;

a door panel that has the window; and a swinging switch apparatus for opening and closing the window that is mounted on an inner side of the door panel substantially in a horizontal direction, the swinging switch apparatus includes:

a switch body;

a switching mechanism that is accommodated in the switch body;

a switch cover that is provided on the door panel so as to cover the switch body and is formed with an opening portion;

an operation knob that is provided at the switch body so as to be exposed at the opening portion; and a regulation mechanism that is disposed between the switching mechanism and the operation knob and swingably supports the operation knob, wherein a through hole communicating with the opening portion is formed in the switch body substantially vertically.

(7) A window regulator according to (6), wherein the through hole is formed at a position directly under a gap formed between the switch cover and the operation knob in the opening.

(8) A window regulator according to (7), wherein the switch cover has a depression so that the operation knob is swung easily, and wherein the through hole is located at a lowest portion of the depression.

(9) A window regulator according to (6), wherein an upper portion of the through hole is lager than a lower portion of the through hole.

(10) A window regulator according to (6), wherein a plurality of the through holes communicating with the opening portion are formed in the switch body.

With the above-described feature, since a part of fine sand which has entered through the opening of the switch cover is immediately discharged to the outside from the through hole, the amount of sand accumulated can be reduced. It is therefore possible to suppress the invasion of fine sand into the switch body and to effectively prevent the accumulated sand from being blown up under changes in air pressure and shocks to enter the internal switching mechanism portion. Thus, problems such as degradation of feel of operation and conduction failures of the switch as encountered in the related art can be eliminated to provide a swinging switch device which can be expected to operate with stability for a long period.

DETAIL DESCRIPTION OF PREFERRED EMBODIMENTS

A description will now be made with reference to FIGS. 1, 2A and 2B on a swinging switch device which is an embodiment of the invention used as a window regulator switch.

Figure 1:
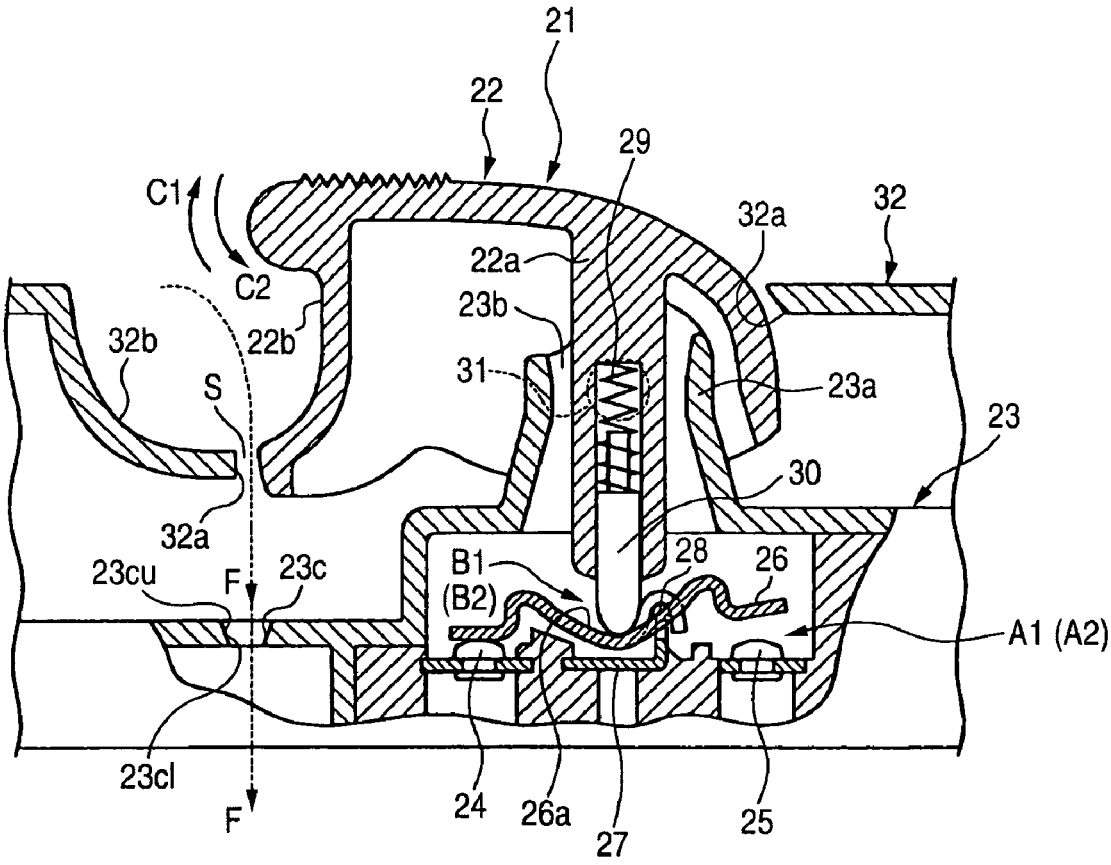
FIG. 1 is a sectional view of an embodiment of the invention which is an application of the invention to a window regulator switch.
Figure 2A:
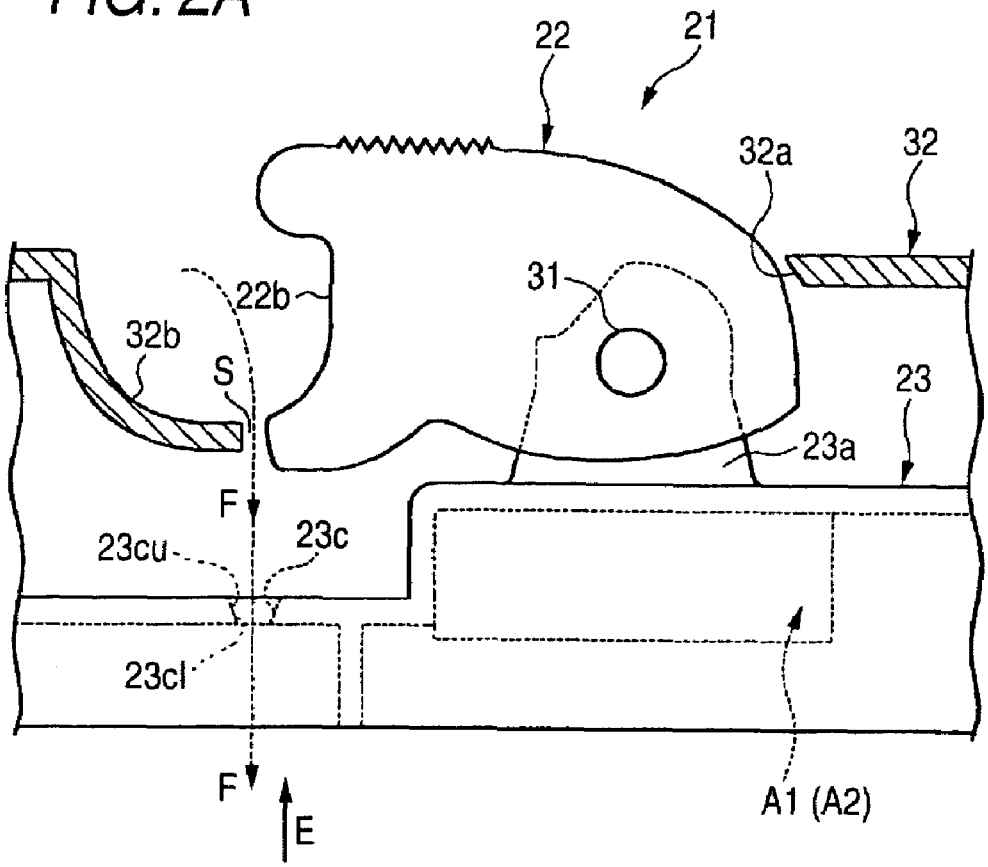
FIG. 2A is a partially cutaway side view of the embodiment in FIG. 1.
Figure 2B:
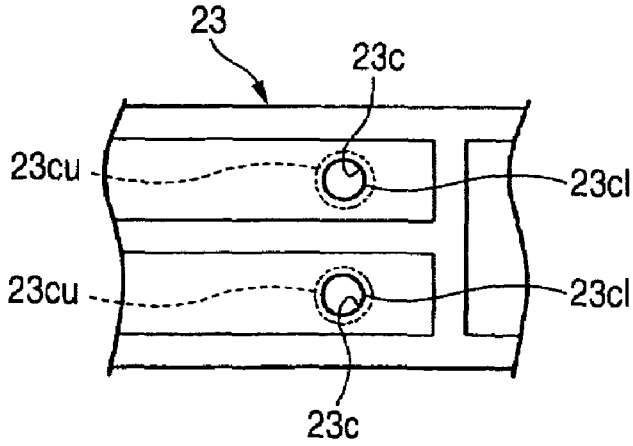
FIG. 2B is a view taken in the direction of the arrow E in FIG. 2A.
Figure 3:
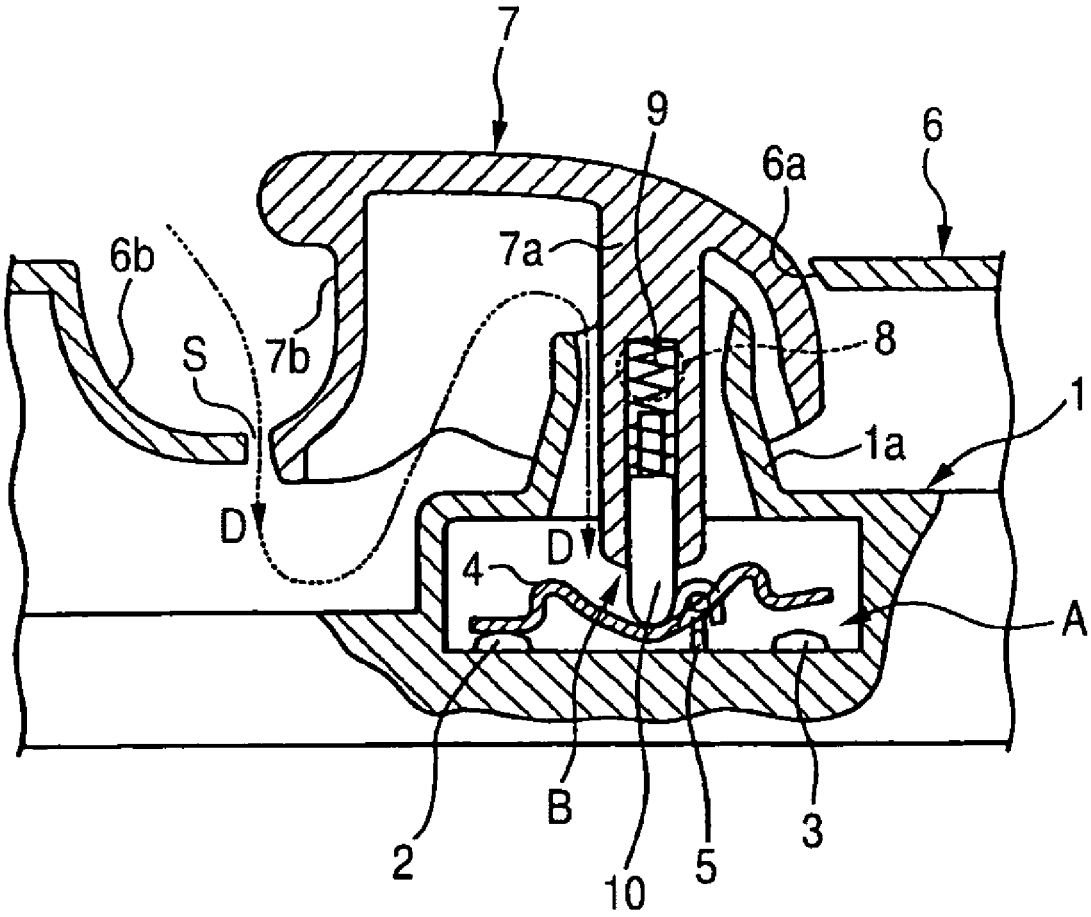
FIG. 3 is an illustration of an example of the related art similar to FIG. 1.
Figure 4:
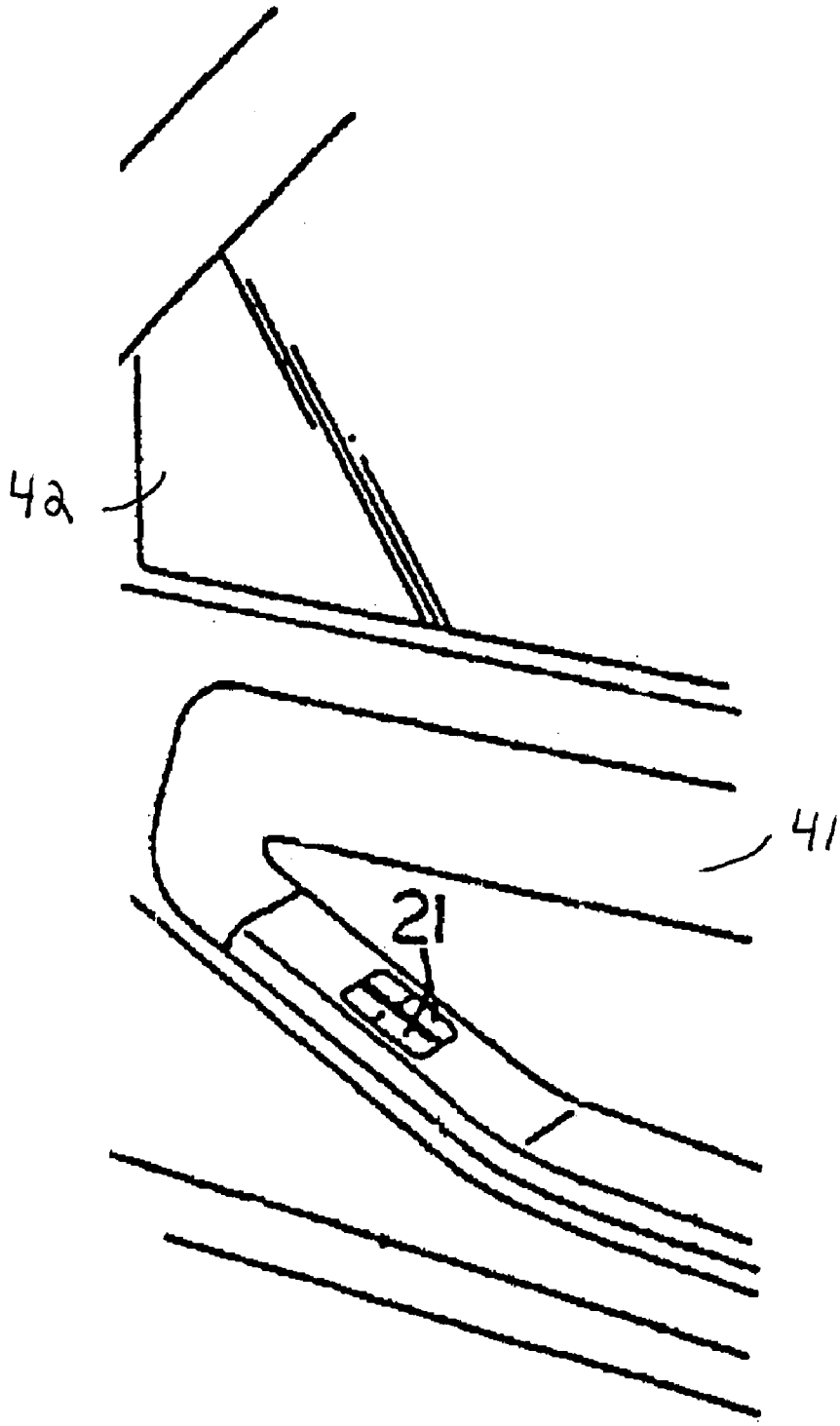
FIG. 4 is an illustration of an embodiment of the invention which is an application of the invention to a window regulator of an automobile.

FIG. 1 is a sectional view showing an internal configuration of a window regulator switch 21. FIG. 2A is a side view of the same. FIG. 2B is a view taken in the direction of the arrow E in FIG. 2A. The window regulator switch 21 is mounted on an inner side of a door panel 41 in a door of an automobile, as shown in FIG. 4. The switch has a pair of switching mechanisms A operating according to an operation of a single operation knob 22, and it opens and closes a desired window 42, as shown in FIG. 4, through a window regulator by energizing and de-energizing a motor (the regulator and motor are not shown).

Referring to a general configuration of the window regulator switch 21, it has an operation knob 22 which is swingably provided, a regulating mechanism B which allows the operation knob 22 to swing at a predetermined angle and allows the knob to be normally held in a standby position substantially in the middle thereof, and the switching mechanisms A which operate according to swing of the operation knob 22. The regulating mechanism B and the switching mechanisms A are provided in a switch body 23 as will be described later. While a pair of switching mechanisms A operating according to the operation knob 22 is provided as described above, a description will now be made on a configuration of one of the switching mechanisms (represented by A1) and the regulating mechanism B.

The switch body 23 is provided so as to project from the inner side of a door, and the operation knob 22 is disposed on the top side of the body. Fixed contacts 24 and 25 constituting the switching mechanism A1 are laterally provided in a lower part of a rectangular space, which is open on the top side thereof, inside the switch body 23. A movable piece 26 which contacts and leaves the fixed contacts 24 and 25 is provided above the contacts. Further, the configuration includes a pivotal support portion 28 which swingably supports the movable piece 26 in the vicinity of the center thereof and which also serves as a common contact 27.

Therefore, the other switching mechanism (represented by A2), which is not shown, adjacent to the mechanism A1 constitutes a similar contact mechanism and is provided in a side-by-side relationship with the mechanism A1 with an appropriate partition wall interposed between them. However, the switching mechanism A1 has a closed circuit configuration in which the movable piece 26 contacts the fixed contact 24 as shown in FIG. 1, whereas the movable piece is in contact with the fixed contact 25 in the other switching mechanism A2. As a result, the window regulator switch 21 keeps a circuit for conduction to a motor, which is not shown, in an off state. Such switching mechanisms A are closed on the top side thereof except a hole 23*b* of a cylindrical wall 23*a* projecting in the substantially middle of them.

Referring to a specific configuration of the movable piece 26, it is swingably suspended and supported by the pivotal support portion 28 and is in electrical conduction to the common contact 27. The movable piece is formed with a recessed portion 26*a* in the middle thereof, which continues to peaks on the left and right sides thereof, and the left and right ends thereof are disposed opposite to the fixed contacts 24 and 25, respectively, such that they can contact and leave the contacts. Surfaces like so-called cams are defined by top surfaces of the movable piece 26 which are inclined surfaces ascending to the left and right in the form of peaks from the recessed portion 26*a* in the middle of the movable piece. A pusher 30, which is urged by a compression coil spring 29 to be described later, is kept in elastic contact with the surfaces, and the pusher 30 is normally held in the recessed portion 26*a* in the middle to keep the window regulator switch 21 in an off state. The configuration also serves as a regulating mechanism B1 which allows the movable piece to swing from side to side at a predetermined angle when the operation knob 22 is operated.

The operation knob 22 is swingably mounted in an upper part of the switch body 23 incorporating such a switching mechanism A1. The operation knob 22 is in the form of a rectangular container which is open on the bottom side thereof, and the knob has a hollow cylindrical portion 22*a* extending downward into a space on the bottom side thereof. The operation knob is assembled with the switch body 23 by inserting the cylindrical portion 22*a* into the hole 23*b* of the cylindrical wall 23*a* of the switch body 23 and by pivotally supporting an intermediate part of the knob with a shaft 31 such that it can rotate.

The compression coil spring 29 and the pusher 30 urged by the spring 29 so as to project outward (downward) are provided in the hollow of the cylindrical portion 22*a*. Therefore, the pusher 30 is kept in elastic contact with a top surface of the movable piece 26 to constitute a regulating mechanism B1 as described above. The pusher, which swings from side to side to contact and leave the fixed contact 24 or 25, always automatically rotates back to the recessed portion 26*a* to be held in that position in a free state. The window regulator switch 21 is thus configured.

The operation knob 22 is formed with a finger engaging portion 22*b* which is an arcuate recess on an outer front wall (the wall on the left side in FIG. 1), and the portion can be caught with a finger when the knob is to be swung in the direction of the arrow C1 in FIG. 1 to improve operability. In this case, a swinging operation in the direction of the arrow C2 in FIG. 1 is performed by depressing a bow portion at the front end of the operation knob 22.

A switch cover 32 is attached and fixed so as to cover the top of the switch body 23 having the above-described configuration. The switch cover 32 is formed with an opening 32*a* at which the top of the operation knob 22 is exposed. Especially, at the edge of the opening facing the finger engaging portion 22*b* of the operation knob 22, a recess 32*b* is formed such that it constitutes an arcuate continuation of the finger engaging portion 22*b* to remove any interference to the insertion of a finger during finger engagement.

As a result, a frame-like gap S is formed in the opening 32*a* around the operation knob 22 which is to be allowed to swing. In the present embodiment, the switch body 23 is formed with a tapered round through hole 23*c* in a part thereof located directly under a part of the gap S at the bottom of the recess 32*b*, the through hole extending vertically and having a diameter increasing toward the top of the same. Such a through hole 23*c* is similarly formed on the side of the other switching mechanism A2, and two such holes are formed side by side as shown in FIG. 2B. Obviously, the holes may be formed in a different manner, and what is required is that the holes are in communication with the opening 32*a* and are provided in positions of the switch body 23 apart from the switching mechanism A1 (A2).

Effects provided by the above configuration will now be described.

First, in a standby state in which the pusher 30 shown in FIG. 1 is held in the recessed portion 26*a* of the movable piece 26 in elastic contact therewith, the window regulator switch 21 is kept in the off state. That is, a motor circuit, which is not shown, is open. When the operation knob 22 is swung in this state at a predetermined angle in the direction of the arrow C1 using the finger engaging portion 22*b* on the front side of the operation knob 22, the pusher 30 is also swung in the same direction about the shaft 31 in sliding contact with the cam-like surface of the movable piece 26.

The left end of the movable piece 26, which is under a resilient force (urging force) from the compression coil spring 29, is kept in contact with the fixed contact 24. On the contrary, contact switching occurs at the corresponding fixed contacts on the side of the other switching mechanism A2 which is not shown. As a result, a forward rotation circuit of the motor is closed to establish conduction through the motor which then operates to open the window, for example, through a window regulator which is not shown.

When the recessed finger engaging portion 22*a* is caught with a finger during the operation, the finger can be easily inserted without interference because the recess 32*b* continuous with the finger engaging portion 22*a* is provided on the switch cover 32 which covers the most part of the window regulator switch 21.

When the force operating the operation knob 22 is removed, the pusher 30 rotates back into the recessed portion 26*a* in sliding contact with the top surface of the movable piece 26 serving also as the regulating mechanism B1, which restores the off state to stop the operation of the window. On the contrary, when the operation knob 22 is conversely swung in the direction of the arrow C2 or when the bow portion at the front end of the operation knob 22 is depressed, the movable piece 26 is made to contact the fixed contact 25 in the figure and to leave the fixed contact 24 by the urging force of the pusher 30 which swings in the same direction. At this time, the state of contact with the fixed contacts at the adjacent or other switching mechanism A2 is not switched and kept as it is. Thus, a reverse rotation circuit of the motor is closed to establish conduction through the motor which then operates to close the window, for example, through the window regulator.

The opening 32*a* for allowing the swing of the operation knob 22 inevitably has the gap S around the operation knob 22, and dust and fine sand can enter through the gap S. In particular, fine sand is likely to accumulate in the recess 32*b* and is likely to enter the switch body 23 through the gap S at the bottom thereof. It is also expected that fine sand will drop into the recess from fingers.

In the present embodiment, since the switch body 23 is formed with the through hole 23*c* vertically extending through the same, at least a part of the fine sand can be immediately discharged downward to the outside as indicated by the arrow F in a broken line in the figure, which makes it possible to reduce the amount of sand and to suppress the accumulation of the same on the switch body 23. This is advantageous in preventing fine sand from being blown up under changes in air pressure and shocks at the time of opening and closing of the door or window and consequently entering the interior of the device through the hole 23*b* of the cylindrical wall 23*a*.

In addition, since the through hole 23*c* is provided in a position directly under a part of the gap S at the bottom of the recess 32*b*, the most part of fine sand which has entered through the recess 32*b* can be immediately discharged to reduce the amount of sand efficiently. Further, since the through hole 23*c* has an upper portion 23*cu* and a lower portion 23*cl*, and the upper portion 23*cu* is lager than the lower portion 23*cl* in diameter, specifically the through hole 23*c* is tapered so as to have a diameter increasing toward the top of the same, fine sand can be easily collected and effectively discharged even when a through hole having a great diameter cannot be provided for limitations of the space.

It is therefore possible to effectively reduce the amount of fine sand which enters through the hole 23*b* at the top end of the cylindrical wall 23*a* after entering through the gap S and to suppress the deposition of fine sand on top surfaces of the movable piece 26 and the fixed contacts 24 and 25 which constitute the internal switching mechanisms A and the regulating mechanism B. For example, this removes failures in the swing of the operation knob 22 back to the standby position attributable to poor sliding of the pusher 30, any degradation of the feel of operation of the knob, and unstable operations such as conduction failures of the switch. The window regulator switch 21 can therefore operate properly with stability for a long period.

As apparent from the above description, the embodiment provides the following advantages.

At least a part of fine sand which has entered through the gap S between the opening 32*a* of the switch cover 32 and the operation knob 22 is immediately discharged to the outside from the through hole 23*c* as indicated by the arrow F. Therefore, the amount of fine sand accumulated is also reduced, which is accordingly advantageous in suppressing the phenomenon of invasion of sand into the switch body 23. In particular, the through hole 23*c* is provided in a position directly under the gap S and is disposed directly under a part of the gap S at the bottom of the recess 32*b* where fine sand is likely to accumulate. It is therefore possible to discharge the sand to the outside from the through hole 23*c* more efficiently and to prevent the accumulation of the sand in the recess 32*b* which is formed for operability.

In addition, since the through hole is tapered so as to have a diameter increasing toward the top of the same, fine sand can be efficiently collected and discharged, which makes it possible to discharge a great amount of fine sand effectively even when a through hole having a large diameter cannot be provided for limitations on the space. As a result, the amount of fine sand entering the switch body 23 can be reduced. It is therefore possible to remove problems such as degradation of sliding and feel of operation of the pusher 30 attributable to deposition of sand on the top surface of the movable piece 26 and consequent failures in the swing of the operation knob 22 back to the standby position. It is also possible to prevent conduction failures of the switch attributable to the deposition of sand on the top surfaces of the fixed contacts 24 and 25. Thus, a swinging switch device can be provided with switching mechanisms A and a regulating mechanism B which operate with stability for a long time even when the device is used in a window regulator switch 21 which is vulnerable to invasion of fine sand.

The invention is not limited to the embodiment described above and illustrated in the drawings and, for example, it may be applied not only to window regulator switches but also to a wide range of swinging switch devices. While the movable piece has been described as being configured to serve also as a regulating mechanism, a configuration may alternatively be employed in which a dedicated regulating mechanism is separately provided.

Referring further to the specific configuration, the through hole provided so as to vertically extend through the switch body is not required to be tapered, and the hole may be a slot instead of a round hole. What is required is that an appropriate number of such holes are provided on the switch body in a part thereof in communication with the opening of the switch cover, and the invention may be thus carried out in various modifications without departing from the scope of the substance of the invention.

What is claimed is:

1. A swinging switch apparatus comprising:

a switch body, the switch body having a through hole, which passes through a first surface and a second surface of the switch body, and the diameter of the through hole continuously decreases from the first surface to the second surface of the switch body;

a switching mechanism that is accommodated in the switch body;

a switch cover that covers the switch body and is formed with an opening portion;

an operation knob that is provided at the switch body so as to be exposed at the opening portion; and a regulation mechanism that is disposed between the switching mechanism and the operation knob and swingably supports the operation knob, wherein the through hole is axially aligned with the opening portion.

2. A swinging switch apparatus according to claim 1, wherein the through hole is formed at a position directly under a gap formed between the switch cover and the operation knob in the opening.

3. A swinging switch apparatus according to claim 2, wherein the switch cover has a recess so that the operation knob is swung easily, and wherein the through hole is vertically aligned with a lowest portion of the recess.

4. A swinging switch apparatus according to claim 1, wherein a plurality of the through holes communicating with the opening portion are formed in the switch body.

5. A window regulator of an automobile comprising:

a window;

a door panel that has the window; and a swinging switch apparatus for opening and closing the window that is mounted on an inner side of the door panel substantially in a horizontal direction, the swinging switch apparatus includes:

a switch body, the switch body having a through hole, which passes through a first surface and a second surface of the switch body, and the diameter of the through hole continuously decreases from the first surface to the second surface of the switch body;

a switching mechanism that is accommodated in the switch body;

a switch cover that is provided on the door panel so as to cover the switch body and is formed with an opening portion;

an operation knob that is provided at the switch body so as to be exposed at the opening portion; and a regulation mechanism that is disposed between the switching mechanism and the operation knob and swingably supports the operation knob, wherein the through hole is axially aligned with the opening portion.

6. A window regulator according to claim 5, wherein the through hole is formed at a position directly under a gap formed between the switch cover and the operation knob in the opening.

7. A window regulator according to claim 6, wherein the switch cover has a recess so that the operation knob is swung easily, and wherein the through hole is vertically aligned with a lowest portion of the recess.

8. A window regulator according to claim 5, wherein a plurality of the through holes communicating with the opening portion are formed in the switch body.

* * * * *